US008957815B2

(12) United States Patent
Chiu et al.

(10) Patent No.: US 8,957,815 B2
(45) Date of Patent: Feb. 17, 2015

(54) COAXIAL CABLE DESIGNED ANTENNA MODULE FOR ELECTRONIC DEVICE

(71) Applicants: Hung-Hsien Chiu, Hsinchu (TW); Chen-Chung Liao, Changhua (TW)

(72) Inventors: Hung-Hsien Chiu, Hsinchu (TW); Chen-Chung Liao, Changhua (TW)

(73) Assignee: Sage Elephant Tech Co., Ltd., Hsinchu County (TW)

( * ) Notice: Subject to any disclaimer, the term of this patent is extended or adjusted under 35 U.S.C. 154(b) by 270 days.

(21) Appl. No.: 13/723,126

(22) Filed: Dec. 20, 2012

(65) Prior Publication Data

US 2014/0104116 A1 Apr. 17, 2014

(30) Foreign Application Priority Data

Oct. 16, 2012 (TW) ..... 101138031 A

(51) Int. Cl.
*H01Q 1/24* (2006.01)

(52) U.S. Cl.
CPC ..... *H01Q 1/24* (2013.01)
USPC ..... 343/702

(58) Field of Classification Search
CPC ..... H01Q 1/24; H01Q 1/242; H01Q 1/22; H01Q 1/2258; H01Q 1/2266
USPC ..... 343/702
See application file for complete search history.

(56) References Cited

U.S. PATENT DOCUMENTS 4,626,862 A * 12/1986 Ma ..... 343/702

* cited by examiner

*Primary Examiner* — Hoang V Nguyen
(74) *Attorney, Agent, or Firm* — Leong C. Lei

(57) ABSTRACT

The coaxial cable designed antenna module is installed inside a casing of an electronic device. The coaxial cable designed antenna module contains an antenna coaxial cable, a radiation resonance region, and an antenna base. The antenna base can be a dielectric component inside the casing or an independent dielectric member. The antenna base has at least a side joined to a conductor for positioning the antenna base inside the casing. The antenna coaxial cable has one end connected to the radiation resonance region on the antenna base. The radiation resonance region can be configured into an antenna style such as single-pole, slot, etc. The negative pole region of the antenna coaxial cable keeps the outer jacket so that the underneath braided mesh is not exposed, and has the outer jacket directly connected to a conductor of the electronic device so as to produce RF signal through disrupted current.

16 Claims, 12 Drawing Sheets

PIFA Antenna-Embedded PIFA Antenna

| Frequency | 2.4GHz | 2.45GHz | 2.5GHz |
|---|---|---|---|
| Efficiency(%) | 63.2 | 66.48 | 62.75 |

PIFA Antenna-Embedded PIFA Antenna

Coaxial Cable Designed Antenna(CCD Antenna)

| Frequency | 2.4GHz | 2.45GHz | 2.5GHz |
|---|---|---|---|
| Efficiency(%) | 72.26 | 72.18 | 73.39 |

Coaxial Cable Designed Antenna(CCD Antenna)

PIFA Antenna-Embedded PIFA Antenna

| Frequency | 2.4GHz | 2.45GHz | 2.5GHz | 5.15GHz | 5.35GHz | 5.6GHz | 5.75GHz | 5.85GHz |
|---|---|---|---|---|---|---|---|---|
| Efficiency(%) | 67.01 | 64.1 | 65.13 | 56.99 | 54.37 | 56.28 | 55.4 | 51.28 |

PIFA Antenna-Embedded PIFA Antenna

Coaxial Cable Designed Antenna(CCD Antenna)

| Frequency | 2.4GHz | 2.45GHz | 2.5GHz | 5.15GHz | 5.35GHz | 5.6GHz | 5.75GHz | 5.85GHz |
|---|---|---|---|---|---|---|---|---|
| Efficiency(%) | 73.83 | 72.97 | 70.89 | 66.42 | 65.44 | 62.57 | 61.77 | 64.38 |

Coaxial Cable Designed Antenna(CCD Antenna)

COAXIAL CABLE DESIGNED ANTENNA MODULE FOR ELECTRONIC DEVICE

TECHNICAL FIELD OF THE INVENTION

The present invention generally relates to antenna, and especially relates to an antenna for wireless communication electronic devices.

DESCRIPTION OF THE PRIOR ART

Portable computers, hand-held electronic devices, and communication devices are gaining popularity. These devices are usually capable of wireless communication capability. For example, some devices can conduct long-range wireless communications through the 850, 900, 1,800, and 1,900 MHz GSM bands, 2,100 MHz or LTE bands, etc. On the other hand, some devices can conduct short-range wireless communications through 2.4, 5 GHz WiFi (IEEE 802.11) bands (alternatively referred to LAN bands), or 2.4 GHz Bluetooth band.

These devices also have very limited space and the configuration of antenna in these devices is difficult, especially when the devices are made to have some specific miniature shape and there is little space left for antenna. The production and assembly of these devices are therefore not easy tasks. For various materials for making an antenna such as hard printed circuit board (PCB), flexible PCB (FPCB), metallic plate, etc., they all need to be preprocessed and formed, and then soldered or riveted to a coaxial cable having a section of a specific length peeled. A coaxial cable is structured as shown in FIG. 1. Cross-sectionally and inside out, there are a positive conductor (i.e., core) 1, an insulator 2, a ground conductor (i.e., braided mesh) 3, and an outer jacket 4. The coaxial cable, due to the materials used for its conductors and insulators, the small diameter, and the light weight, can save significant space inside an electronic device. Together with its robustness to bending and high immunity to noise, the coaxial cable is widely applied as antennas to various electronic products.

However, not only the preprocessing and forming take time and cost, the coaxial cable's cutting, peeling, and dipping solder also take more time and cost. Conducting antenna soldering also has relatively higher technology barrier, leading to inferior production yield. Using soldering also requires the purchase and installation of air filtering apparatus. An improved antenna for electronic devices is as such required.

SUMMARY OF THE INVENTION

The present invention provides a coaxial cable designed antenna module for an electronic device. The electronic device can be a desktop computer, a portable computer, a handheld electronic device, a wireless communication device, a notebook computer, a table computer, a cellular phone, a smart phone, a TV, or a wireless access point. The electronic device has a casing and the coaxial cable designed antenna module is installed inside the casing. In contrast to a conventional antenna which requires a support structure, the coaxial cable designed antenna module contains an antenna coaxial cable, a radiation resonance region, and an antenna base. The antenna base can be a dielectric component inside the casing or an independent dielectric member.

The antenna base has at least a side joined to a conductor for positioning the antenna base inside the casing. The side of the antenna base can have positioning pole, rib, groove, hole, etc., matching in shape and fastened to the conductor inside the casing.

The antenna coaxial cable has one end connected to the radiation resonance region on the antenna base. The radiation resonance region can be configured to cover multiple communication bands. For example, the radiation resonance region can cover both 2.4 GHz and 5 GHz bands. The radiation resonance region can be configured into an antenna style such as single-pole, slot, etc. The negative pole region of the antenna coaxial cable keeps the outer jacket so that the underneath braided mesh is not exposed, and is directly and tightly connected to an conductor of the electronic device (the conductor can be a conductive element or a conductive material) so as to produce RF signal through disrupted current. As such, time and cost for peeling, cutting, and dipping solder are saved, technology barrier for delicate soldering is reduced, and the production yield is improved. These are the main objective of the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
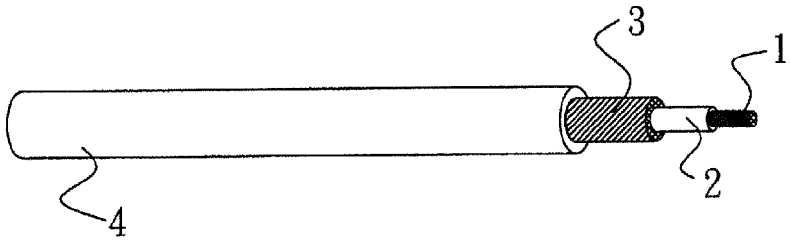
FIG. 1 is a perspective diagram showing a coaxial cable commonly applied to various electronic products.
Figure 2:
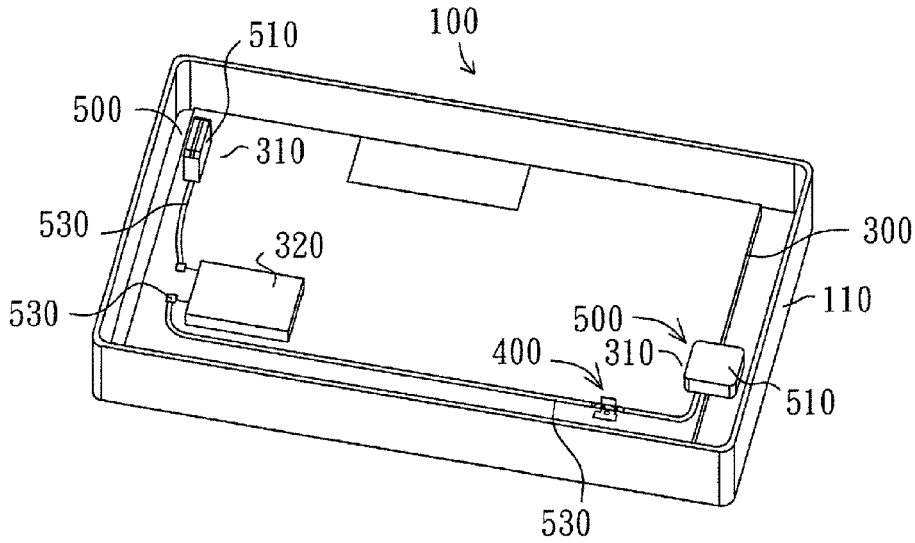
FIG. 2 is a perspective diagram showing an exemplary electronic device having antennas according to embodiments of the present invention.
Figure 3:
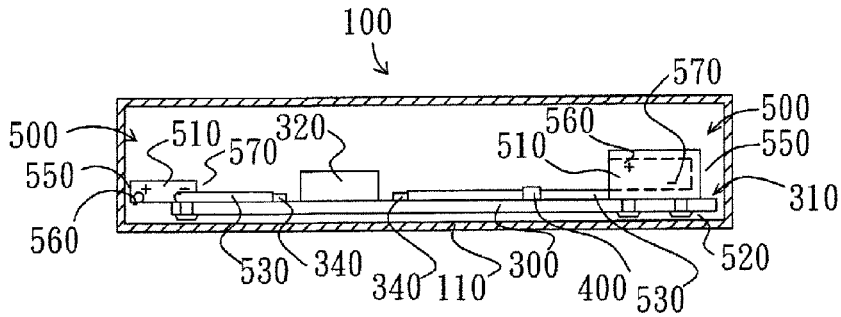
FIG. 3 is a sectional diagram showing the electronic device of FIG. 2.

As shown in FIGS. 2 and 3, at least a coaxial cable designed antenna module 500 is housed in a casing 110 of an electronic device 100 that the coaxial cable designed antenna module 500 is designed for (in the drawings two coaxial cable designed antenna modules 500 are shown). The coaxial cable designed antenna module 500 contains an antenna coaxial cable 530, a radiation resonance region 550, and an antenna base 510. The antenna base 510 can be a dielectric component of the casing 110 or, as shown in the drawings, an independent dielectric member. The antenna base 510 has at least a side joined to a conductor for positioning the antenna base 510 inside the casing 110. The side of the antenna base 510 can have positioning pole, rib, groove, hole, etc., matching in shape and fastened to the conductor inside the casing 110. The conductor can be a conductive element 310 shown in the drawings or, as will be described later, a conductive material 350. Alternatively, the side of the antenna base 510 can be attached to the conductor of the casing 110 simply be adhesive. The antenna coaxial cable 530 has one end connected to the radiation resonance region 550 on the antenna base 510. The radiation resonance region 550 extends from the conductor's grounding region (the conductor can be a conductive element 310 shown in the drawings or, as will be described later, a conductive material 350) to the end of the antenna coaxial cable 530, and can be configured into an antenna style such as single-pole, slot, etc. The radiation resonance region 550's antenna coaxial cable 530 has a section of the outer jacket 4 and braided mesh 3 removed, leaving only insulator 2 and core 1 and forming a positive pole region 560. The braided mesh 3 in another section of the radiation resonance region 550's antenna coaxial cable 530 that does not have the outer jacket 4 removed forms a negative pole region 570 (the outer jacket 4, braided mesh 3, insulator 2, and core 1 of the antenna coaxial cable 530 are not shown in the drawings; please refer to FIG. 1). The positive and negative pole regions 560 and 570 transmit and receive radio frequency (RF) signals. The positive pole region 560 is the core 1 of the antenna coaxial cable 530 whereas the negative pole region 570 is the braided mesh 3 of the antenna coaxial cable 530. If required for specific signal, the antenna coaxial cable 530 in the radiation resonance region 550 can keep a section of outer jacket 4 and braided mesh 3 at the end of the antenna coaxial cable 530, and electrically connect the core 1 at the radiation end point (positive pole region 560) to the kept braided mesh 3 (negative pole region 570) so as to form an equivalent capacitor and as such enhance the antenna's frequency and bandwidth. The negative pole region 570 of the antenna coaxial cable 530 keeps the outer jacket 4 so that the braided mesh 3 is not exposed, and is directly and tightly connected to the conductor of the electronic device 100 (the outer jacket 4 and braided mesh 3 are not shown in the drawings; please refer to FIG. 1; the conductor can be a conductive element 310 shown in the drawings or, as will be described later, a conductive material 350) so as to produce RF signal through disrupted current. The various components of the electronic device 100 and the coaxial cable designed antenna module 500 are further described as follows.

The electronic device 100 is equipped with wireless communication circuit for conducting wireless communications through one or more wireless communication bands, which all require antennas. The electronic device 100 can be a desktop computer, a portable computer (e.g., a laptop computer, a tablet computer, etc.), a handheld electronic device (e.g., a cellular phone, a smart phone, etc.), a wireless communication device (e.g., a wireless access point, etc.), a television, etc. The electronic device 100 can also be a small, wearable device such as a watch, a headset, an earphone, etc. Other examples of the electronic device 100 include a personal digital assistant, a game device, a global positioning system (GPS) device, etc. As outlined above, the electronic device 100 can have various functions.

The electronic device 100 usually contains a storage and a processing circuit. The storage can contain one or more hard disk drive, non-volatile memory, volatile memory, etc. The processing circuit controls the operation of the electronic device 100, and may contain a microprocessor or other appropriate integrated circuit. The storage and processing circuit may jointly support the execution of a software on the electronic device 100. The software can be a browser, a VoIP program, an electronic mail program, a video player, an image capture program, etc. The storage and processing circuit also support an appropriate communication protocol such as the Internet protocol, the wireless communication protocol (e.g., IEEE 802.11 or WiFi), the short-distance wireless protocol (e.g., Bluetooth, Zigbee, etc.). The electronic device 100 may also contain input/output circuit for exchanging data with other external devices. The input/output circuit may provide input/output interfaces such as touch screen, buttons, joystick, optical sensor, trackball, touch panel, keypad, keyboard, microphone, camera, etc. A user can issue commands to control the electronic device 100 through these input/output interfaces. On the other hand, the electronic device 100 may contain display and audio/video devices such as speakers, surveillance cameras, or other similar devices. The electronic device 100 may also contain connectors or jacks for connecting external audio/video devices.

For an electronic device 100 capable of wireless communications, it usually contains a wireless communication circuit containing one or more integrated circuits, power amplifier, low-noise amplifier, passive RF components, one or more antennas, RF transceiver, or optical components for using light (e.g., infrared) as earner. The transceiver usually can handle communications over multiple frequency bands. For example, it can handle communications over the 2.4 GHz and 5 GHz bands for WiFi (IEEE 802.11) and the 2.4 GHz band for Bluetooth. In other electronic devices 100, it can handle communications over the 850 MHz, 900 MHz, 1800 MHz, and 1900 MHz GSM bands and 2100 MHz data band. There are also various embodiments that are capable of GPS signal, radio and TV signal, or paging signal reception and transmission. The wireless communication circuit usually contains at least an antenna. A part of or the whole antenna is the coaxial cable designed antenna module 500, which contains an antenna base 510 and an antenna coaxial cable 530 forming a radiation resonance region 550.

Figure 4:
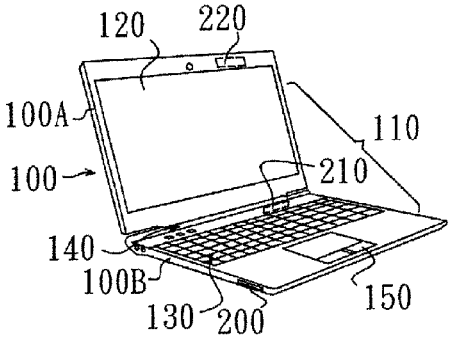
FIG. 4 is a perspective diagram showing the appearance of an exemplary electronic device having at least an antenna of the present invention.
Figure 5:
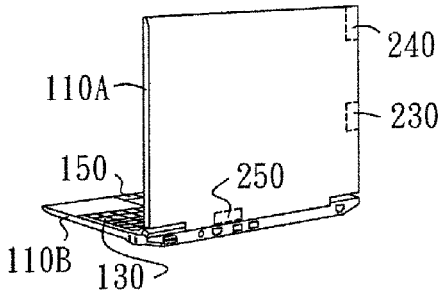
FIG. 5 is a perspective diagram showing the electronic device of FIG. 4 from a different angle.

The electronic device 100 usually has a casing (or housing) 100 made of plastic, wood, glass, ceramic, metal, or other appropriate material, or any appropriate composite material combining the above. Sometime, a portion of the casing 110 is made by a dielectric or other low electrically conductive material so as not to interfere with the antenna. As illustrated in FIGS. 4 and 5, the electronic device 100 is a portable computer. The casing 110 can be an integral object or, as shown in FIGS. 4 and 5, may contains an upper casing (or cover) 110A and a lower casing (or main unit) 110B hinged together by hinges 140. A display 120 may be configured on a surface of the upper casing 110A, and a keyboard 130 and a touch panel 150 can be configured on the lower casing 110B. The casing 110 can also be an integral object if the display 120, the keyboard 130, and the touch panel 150 are integrated into a touch screen.

The coaxial cable designed antenna module 500 can be configured in the electronic device 100 at places, for example, marked as 200, 210, and 220 in FIG. 4. The region 200 is in a left front area of the lower casing 110B. The region 210 is in a back right area of the lower casing 110B. The region 220 is in a front upper area of the upper casing 110A. Alternatively, the coaxial cable designed antenna module 500 can be configured in the electronic device 100 at places, for example, marked as 230, 240, and 250 in FIG. 5. The region 230 is along an edge of the upper casing 110A. The region 240 is at a corner of the upper casing 110A. The region 250 is in a front lower area of the upper casing 110A. The location of the coaxial cable designed antenna module 500 is not limited to these described above.

Figure 6:
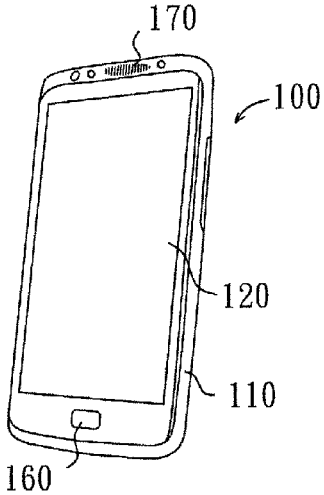
FIG. 6 is a perspective diagram showing the appearance of another exemplary electronic having at least an antenna of the present invention.
Figure 7:
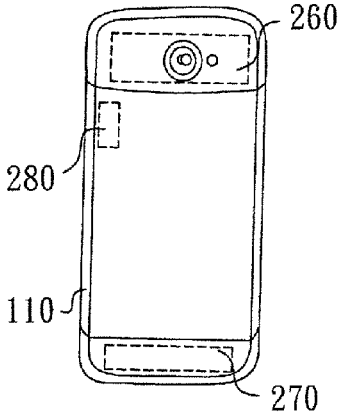
FIG. 7 is a perspective diagram showing the electronic device of FIG. 6 from a different angle.
Figure 8:
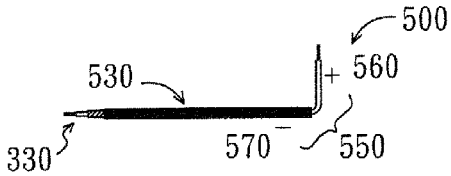
FIG. 8 is a schematic diagram showing a first radiation resonance region along a coaxial cable functioning as an antenna according to the present invention.
Figure 9:
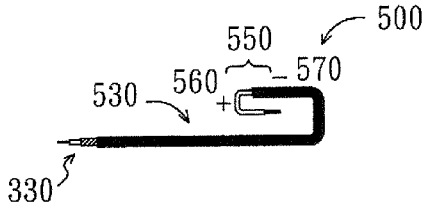
FIG. 9 is a schematic diagram showing a second radiation resonance region along a coaxial cable functioning as an antenna according to the present invention.
Figure 10:
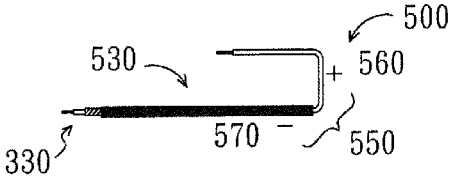
FIG. 10 is a schematic diagram showing a third radiation resonance region along a coaxial cable functioning as an antenna according to the present invention.
Figure 11:
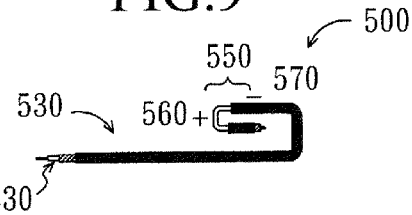
FIG. 11 is a schematic diagram showing a fourth radiation resonance region along a coaxial cable functioning as an antenna according to the present invention.

As illustrated in FIGS. 6 and 7, the electronic device 100 can be a handheld electronic device such as a mobile phone. The electronic device 100 usually has a casing 100 made of plastic, wood, glass, ceramic, metal, or other appropriate material, or any appropriate combination of the above. A display 120 such as a touch screen can be configured on a front surface of the electronic device 100. The electronic device 100 can have a speaker port 170 or other input/output port. There is also one or more buttons or other input/output devices for collecting user input. As shown in FIG. 7, the coaxial cable designed antenna module 500 can be configured at various places inside the casing 110 such as those marked as 260, 270, and 280. These locations are exemplary only and the coaxial cable designed antenna module 500 can be configured any other appropriate locations inside the casing 110.

The coaxial cable designed antenna module 500 of the electronic device 100 is use to transmit and receive RF signal, and can be designed to cover a single frequency band or multiple frequency bands. For example, as a multi-band antenna, it can cover multiple mobile communication bands or WiFi bands. The radiation resonance region 550 can be configured for various bands or combinations of bands. For another example, the antenna can be single-band or multi-band antenna for wireless LAN, a multi-band antenna for mobile communications, or a single-band antenna for GPS. The RF signal is transmitted or received by a RF transceiver 320 on a circuit board 300 (the circuit board 300 can be the conductive element 310 mentioned above). The antenna coaxial cable 530 of the coaxial cable designed antenna module 500 can has its other end opposing the radiation resonance region 550 connected to the RF transceiver 320 and other components on the circuit board 300. The radiation resonance region 550 can be configured into an antenna style such as single-pole, slot, etc.

Figure 12:
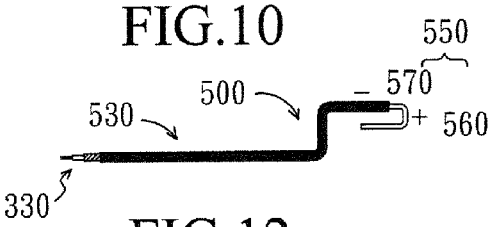
FIG. 12 is a schematic diagram showing a fifth radiation resonance region along a coaxial cable functioning as an antenna according to the present invention.
Figure 13:
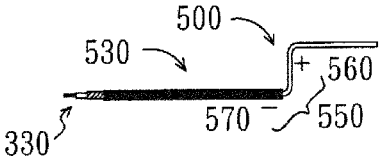
FIG. 13 is a schematic diagram showing a sixth radiation resonance region along a coaxial cable functioning as an antenna according to the present invention.
Figure 14:
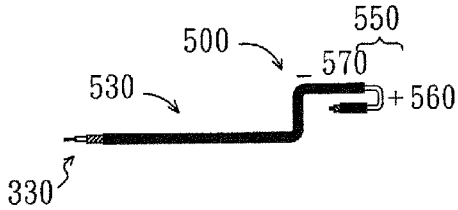
FIG. 14 is a schematic diagram showing a seventh radiation resonance region along a coaxial cable functioning as an antenna according to the present invention.

As shown in FIGS. 8 to 11, the antenna coaxial cable 530 can be configured to contain a radiation resonance region 550. The positive and negative pole regions 560 and 570 of the radiation resonance region 550 are included in the antenna coaxial cable 530. The end of the antenna coaxial cable 530 inside the radiation resonance region 550 that has the braided mesh 3 removed and the insulator 2 (including the core 1)

exposed partly becomes the positive pole region 560. The negative pole region 570 keeps the outer jacket and has the braided mesh 3 beneath concealed (the braided mesh 3 is underneath the outer jacket and is not shown), and is tightly connected to the conductive element 310 (not shown, please see FIG. 2) of the electronic device 100 at an appropriate place so as to produce RF signal through disrupted current, to achieve the frequency requirement of the coaxial cable designed antenna module 500, and to enhance its characteristics. The other end of the antenna coaxial cable 530 opposing the radiation resonance region 550 is peeled to form a RF source 330. The positive conductor and ground conductor of the RF source 330 can be connected to a RF connection region 340 of the RF transceiver 320 (shown in FIG. 2) by means such as soldering, pressing, clamping, or other so-called conduction overlapping means. Through the RF source 330, the RF transceiver 320 is conducted to the coaxial cable designed antenna module 500. The RF signal from the coaxial cable designed antenna module 500 is produced by the radiation resonance region 550. FIGS. 12 to 14 depict various other configurations of the radiation resonance region 550 of the coaxial cable designed antenna module 500.

Figure 15:
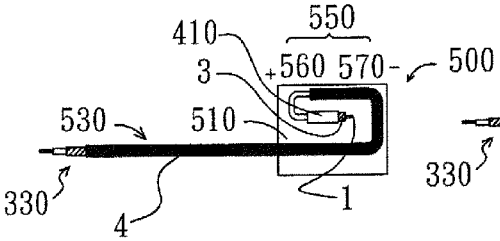
FIG. 15 is a schematic diagram showing a core at an end point of a positive pole region connected to a braided mesh according to an embodiment of the present invention.
Figure 16:
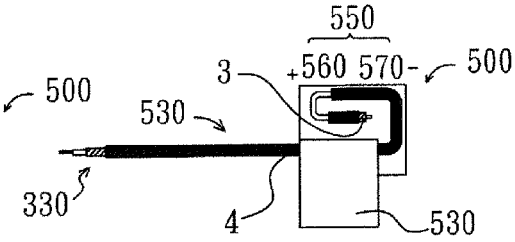
FIG. 16 is a schematic diagram showing a conductive material attached to an outer jacket to extend resonant area according to an embodiment of the present invention.

As shown in FIG. 15, the core 1 at an end point of the positive pole region 560 can be connected to the braided mesh 3 to form capacitor loading 410 so as to enhance the coaxial cable designed antenna module 500's frequency and bandwidth. The connection can be achieved by riveting, soldering, dispensing conductive material, etc. (i.e., the conduction overlapping means). The capacitor loading 410 can also connect the core 1 at an end point of the positive pole region 560 to a metallic plate, a metallic tube, or coated conductive material by riveting, soldering, dispensing conductive material, etc. (i.e., the conduction overlapping means). If the braided mesh 3 of the antenna coaxial cable 530 cannot connect with a conductive element or does not have enough resonant area, a conductive material 350 can be attached to the outer jacket 4 to extend the resonant area as shown in FIG. 16. To improve the attachment of the conductive material 350, the outer jacket 4 outside the corresponding braided mesh 3 can be removed partially or entirely.

Figure 17:
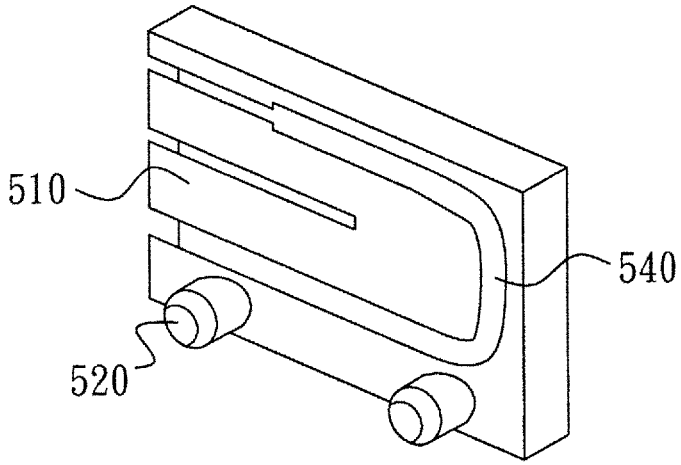
FIG. 17 is a perspective diagram showing a first antenna base according to the present invention.
Figure 18:
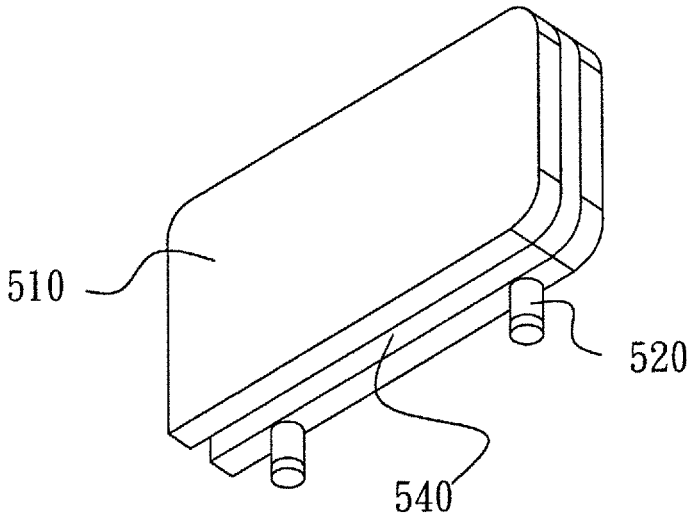
FIG. 18 is a perspective diagram showing a second antenna base according to the present invention.
Figure 19:
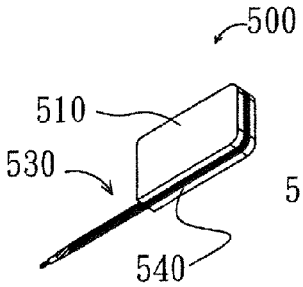
FIG. 19 is a perspective diagram showing a radiation resonance region and an antenna base according to a first embodiment of the present invention based on an electronic device's environment and characteristics requirement.
Figure 20:
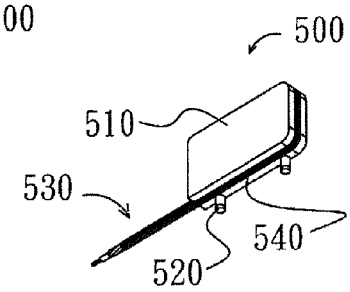
FIG. 20 is a perspective diagram showing a radiation resonance region and an antenna base according to a second embodiment of the present invention based on an electronic device's environment and characteristics requirement.
Figure 21:
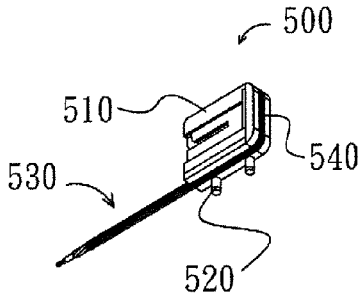
FIG. 21 is a perspective diagram showing a radiation resonance region and an antenna base according to a third embodiment of the present invention based on an electronic device's environment and characteristics requirement.
Figure 22:
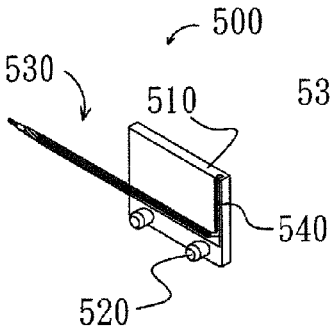
FIG. 22 is a perspective diagram showing a radiation resonance region and an antenna base according to a fourth embodiment of the present invention based on an electronic device's environment and characteristics requirement.
Figure 23:
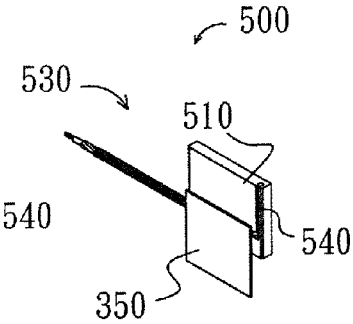
FIG. 23 is a perspective diagram showing a radiation resonance region and an antenna base according to a fifth embodiment of the present invention based on an electronic device's environment and characteristics requirement.
Figure 24:
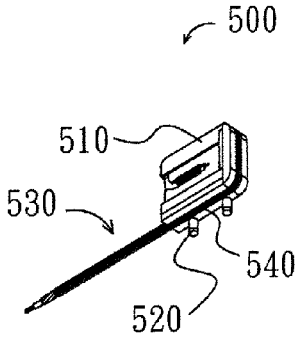
FIG. 24 is a perspective diagram showing a radiation resonance region and an antenna base according to a sixth embodiment of the present invention based on an electronic device's environment and characteristics requirement.

As shown in FIGS. 17 and 18, as well as FIGS. 2 and 3, the antenna base 510 can be an independent dielectric member, or a dielectric component extended from inside of the casing 110, as will be described later. The antenna base 510 generally has a rectangular shape with a cable duct 540 configured at an appropriate place (on the surface or inside) for fixing the radiation resonance region 550 and to adjust the antenna characteristics. In general, a part of or the entire cable duct 540 has an aperture compatible with the diameter of the radiation resonance region 550 so as to achieve tight embedment. The location of the antenna base 510 can be adjusted in accordance with the space of the electronic device 100, and the location, dimension, and reception characteristics of the conductor (referring to the conductive element 310 only, or with the conductive material 350 included), and is tightly joined to the conductor of the electronic device 100. The antenna base 510 can be laid upright or flatly. As shown in FIG. 2, the antenna base 510 to the left is erected upright whereas the one to the right is flatly positioned. In addition, the antenna base 510 has at least a side matching the shape of the conductor for positioning the antenna base 510 inside the casing 110 of the electronic device 100. For example, the side can be shaped to have at least one pole, rib, slot, hole, etc. to as to join the conductor inside the casing 110 of the electronic device 100. Alternatively, instead of having pole, rib, slot, hole, etc., the side is joined to the conductor only with adhesive. Then, the radiation resonance region 550 is formed on the antenna coaxial cable 530 according to the frequency requirement, and the antenna coaxial cable 530 is installed on antenna base 510. As described, there is a significant convenience in installing the antenna base 510 of the electronic device 100. As shown in FIGS. 17 and 18, the antenna base 510's having poles 520 facilitates the joining of the coaxial cable designed antenna module 500 to the circuit board 300. As shown in FIGS. 2 and 3, the coaxial cable designed antenna module 500 is connected to a RF connection region 340 (i.e., the RF connection region 340 on the circuit board 300). The RF connection region 340 is connected to the antenna coaxial cable 530 through soldering, pressing, clamping, etc. (i.e., the conduction overlapping means). The RF transceiver 320 is installed on the circuit board 300, and is connected to the antenna coaxial cable 530 through the RF connection region 340 and the traces on the circuit board 300. The antenna coaxial cable 530 has a positive conductor (i.e., core) and ground conductor (i.e., braided mesh) (both positive and negative conductors are not shown in the drawings; please see FIG. 1). As shown in FIG. 2, a noise suppression element 400 can be configured at a specific location along the ground conductor. The noise suppression element 400 is an electrical conductor such as a metallic leaf spring, a metallic ring, a conductive tape, a metallic wire, or a ferrite.

In addition, as the casing 110 of the electronic device 100 and its interior are sometimes made of dielectric and conductor, the design of the coaxial cable designed antenna module 500 can utilize this feature and use a portion of the dielectric and conductive casing 110 as the antenna base 510. This antenna base 110 has at least a side matched in shape and joined to a conductor for positioning the antenna base 510 inside the casing 110. The side of the antenna base 510 can have positioning pole, rib, groove, hole, etc.

As such, the coaxial cable designed antenna module 500 capable of various configurations can be installed at any appropriate place in the electronic device 100 by the antenna base 510, and the antenna frequency characteristics can be quickly adjusted according to the demand. The present invention, through the antenna base 510, and by keeping the outer jacket 4 and not exposing the underneath braided mesh 3 in the negative pole regions 570 of one or more antenna coaxial cables 530 in the electronic devices 100, directly connects the outer jacket 4 with the conductor of the electronic device 100 (the outer jacket 4 and the braided mesh 3 are not shown; please see FIG. 1), and produces RF wave through disrupted current.

Figure 25:
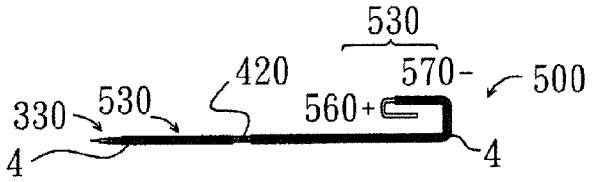
FIG. 25 is a schematic diagram showing a noise suppression element at a specific location on exposed braided mesh according to an embodiment of the present invention.

Some additional configurations of the coaxial cable designed antenna module 500 are shown in FIGS. 19 to 24. These coaxial cable designed antenna modules 500 vary the configuration of the radiation resonance region 550 and the shape of the antenna base 510 in accordance with the electronic devices 100's environment and characteristics requirement and, by optionally attaching conductive material 350 to extend the resonant area, achieve enhanced design and usage flexibility of the coaxial cable designed antenna modules 500. In an embodiment shown in FIG. 25, when the RF transceiver 320 (please FIGS. 2 and 3) or other component in the electronic device 100 produces noises, an appropriate section of the antenna coaxial cable 530 can have the outer jacket 4 peeled and the braided mesh 420 exposed to divert noise signals. Then, by incorporating noise suppression element 400 (please see FIGS. 2 and 3) such as a metallic leaf spring, a metallic ring, a conductive tape, a metallic wire, or a ferrite, the noises can be reduced by conducting the conductive element 310.

Figure 26:
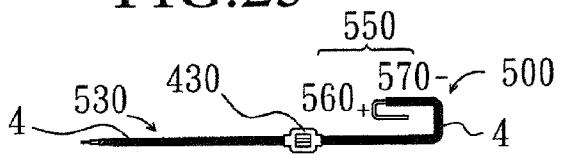
FIG. 26 is a schematic diagram showing an impedance adjustment element on a coaxial cable according to an embodiment of the present invention.

In an embodiment shown in FIG. 26, the impedance characteristics of the coaxial cable designed antenna module 500 can be tuned by adjusting the radiation resonance region 550 or by configuring an impedance adjustment element 430 at an appropriate location along the antenna coaxial cable 530. The impedance adjustment element 430 can be implemented using a material with metal such as a hard printed circuit board (PCB), a flexible PCB (FPCB), a metallic plate, etc. Depending on the antenna's frequency and characteristics requirement, an impedance adjustment element 430 of a different style and dimension can be used. The installation of the impedance adjustment element 430 can be achieved by riveting, soldering, dispensing conductive material, etc. (i.e., the conduction overlapping means). After installation, the impedance adjustment element 430 can be coated with an insulating material such as heat-shrinkable tubing, plastic patch, or plastic forming, etc. so as to enhance its mechanical strength. If the impedance adjustment element 430 is conducted, the conductive element 310 shown in FIGS. 2 and 3 also has noise suppression function.

Figure 27:
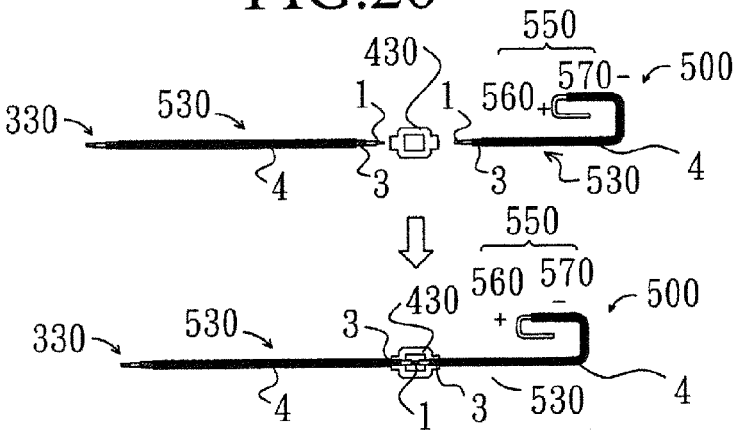
FIG. 27 is a schematic diagram showing an impedance adjustment element on a coaxial cable according to an embodiment of the present invention.
Figure 28:
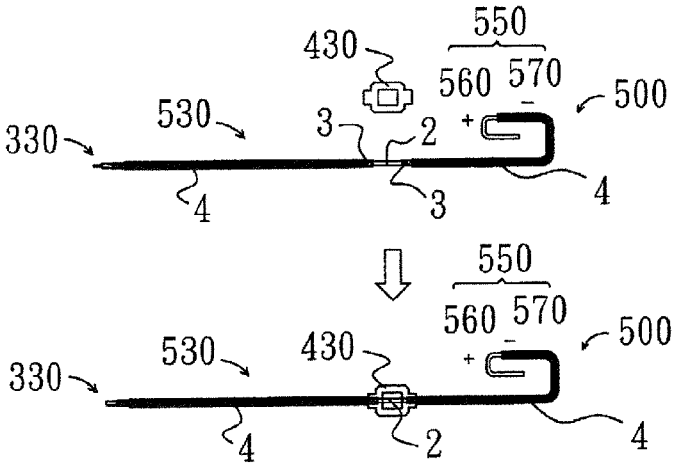
FIG. 28 is a schematic diagram showing another installation of an impedance adjustment element on a coaxial cable according to an embodiment of the present invention.

The configuration of the impedance adjustment element 430 on the antenna coaxial cable 530 can be achieved as shown in FIGS. 27 and 28. As illustrated in FIG. 27, the antenna coaxial cable 530 is separated into two sections. The two sections are appropriately peeled and then the impedance adjustment element 430 is installed with the braided meshes 3 of the two sections connected to the metallic part of the impedance adjustment element 430, and the cores 1 of the two sections connected. The connection can be achieved by riveting, soldering, dispensing conductive material, etc. (the conduction overlapping means). As shown in FIG. 28, an appropriate section of the antenna coaxial cable 530 is peeled to remove the braided mesh 3 but keep the braided meshes 3 at the two ends of the section, and then the impedance adjustment element 430 is installed with the insulator 2 remaining intact. The braided meshes 3 at the two ends are connected to the metallic part of the impedance adjustment element 430. The connection can be achieved by riveting, soldering, dispensing conductive material, etc. (the conduction overlapping means).

Figure 29:
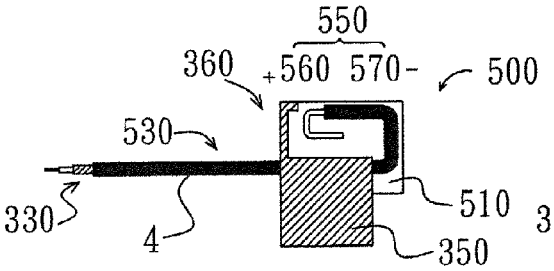
FIG. 29 is a schematic diagram showing the configuration of a first conductive molding according to the present invention based on antenna characteristics requirement.
Figure 30:
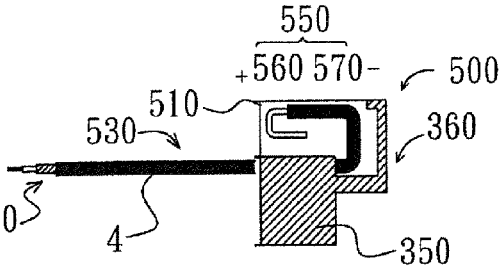
FIG. 30 is a schematic diagram showing the configuration of a second conductive molding according to the present invention based on antenna characteristics requirement.

To avoid interference between multiple antennas, as shown in FIGS. 29 and 30, a conductive material 350 can be attached to the radiation resonance region 550. Furthermore, a conductive molding 360 of an appropriate dimension can be connected to the conductive material 350 along a side of the radiation resonance region 550 according to characteristics requirement. Alternatively, the conductive material 350 and the conductive molding 360 can be integrally formed and attached to the antenna base 510 so as to alter the distribution of antenna current and to enhance the isolation from other antennas.

Figure 31:
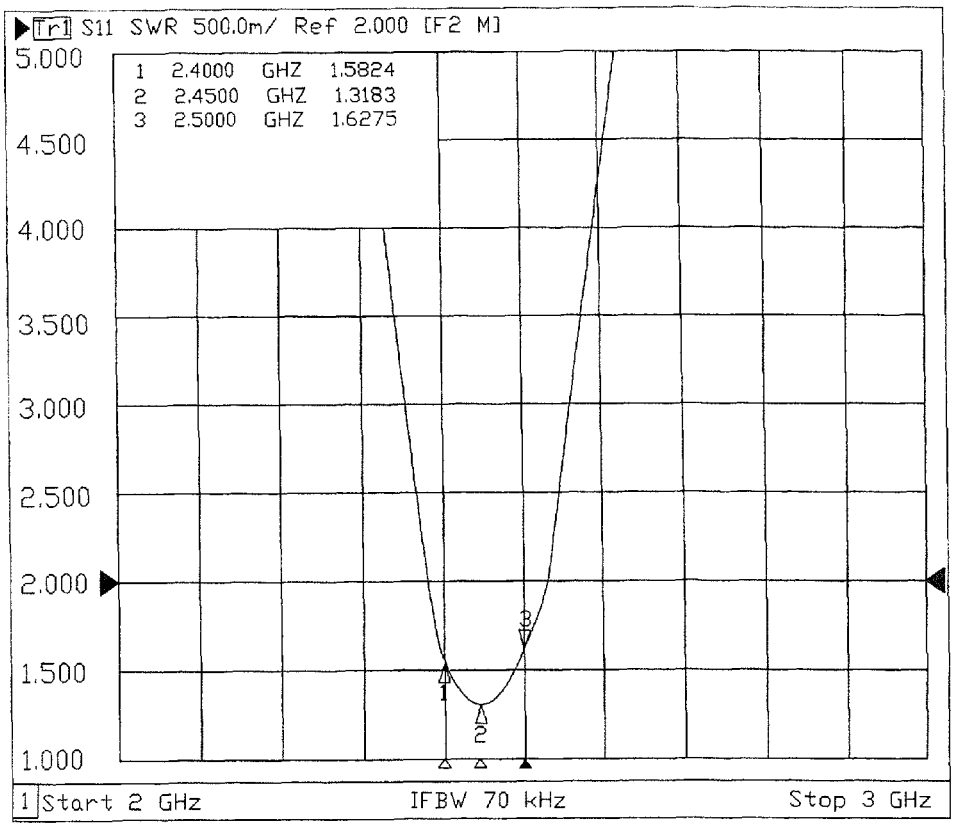
FIG. 31 shows the efficiency and VSWR test results of a d a general single-frequency PIFA antenna.
Figure 32:
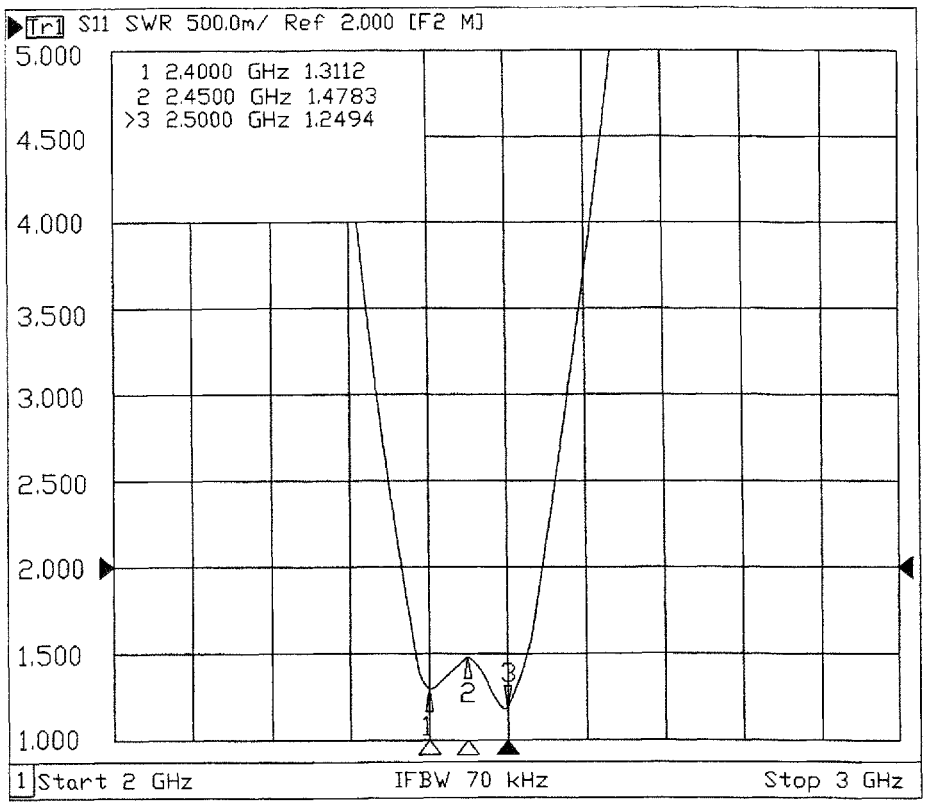
FIG. 32 shows the efficiency and VSWR test results of a single-frequency coaxial cable designed antenna module.
Figure 33:
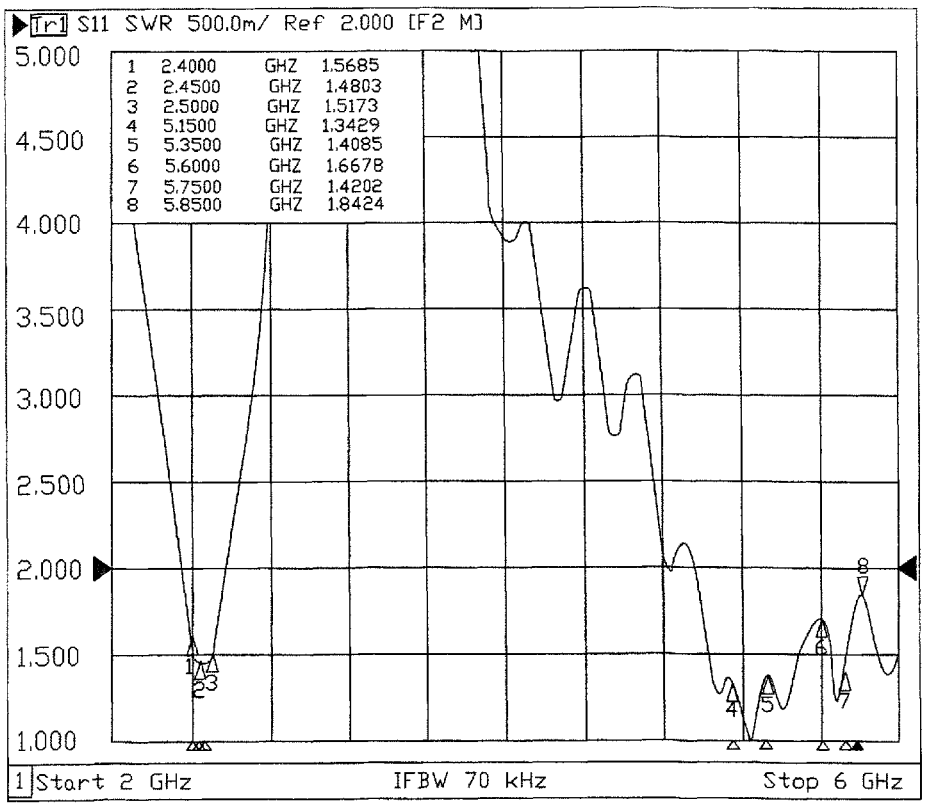
FIG. 33 shows the efficiency and VSWR test results of a d a general dual-frequency PIFA antenna.
Figure 34:
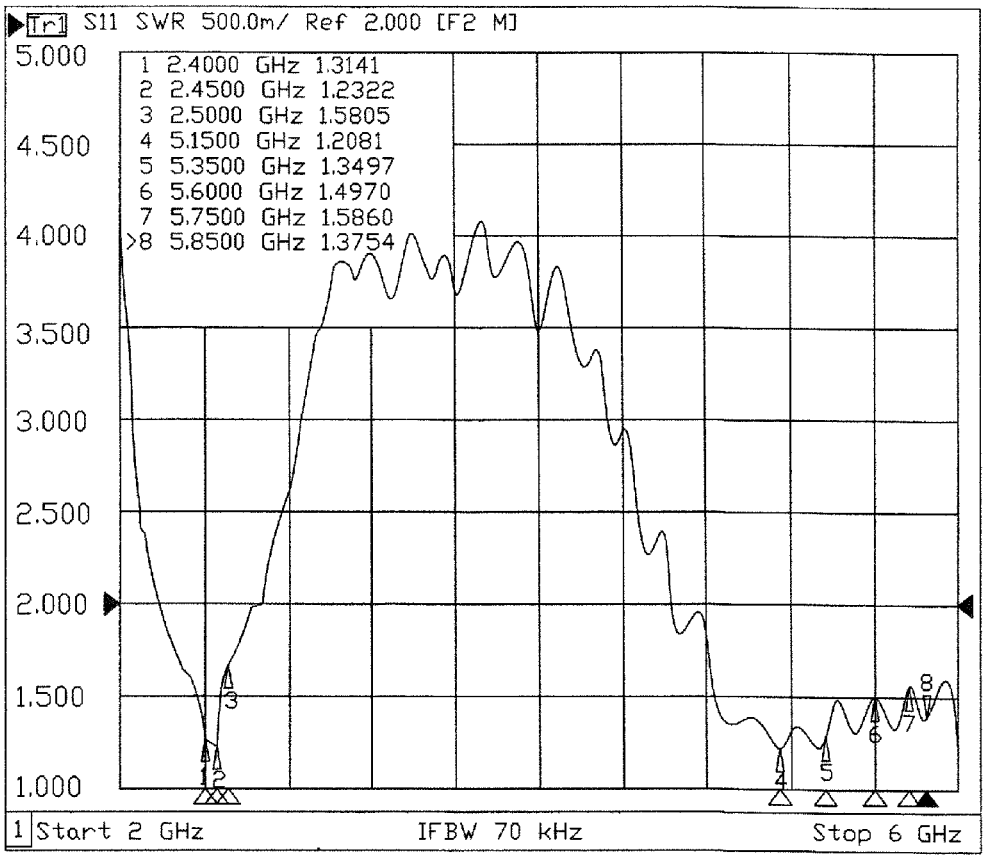
FIG. 34 shows the efficiency and VSWR test results of a dual-frequency coaxial cable designed antenna module.

The performance of the coaxial cable designed antenna module 500 can be observed by comparing the efficiency and VSWR test results between a general single-frequency PIM antenna module shown in FIG. 31 and a single-frequency coaxial cable designed antenna module shown in FIG. 32, and between a general dual-frequency PIFA antenna module shown in FIG. 33 and a dual-frequency coaxial cable designed antenna module shown in FIG. 34. From these test results, the coaxial cable designed antenna module 500 of the present invention achieves superior antenna performance, in addition to advantages such as rapid production and installation, economical, and environmental friendliness.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A coaxial cable designed antenna module installed in a casing of an electronic device, comprising an antenna coaxial cable for transmitting RF signal;

a radiation resonance region at an end of the antenna coaxial cable extending from a ground region of a conductor of the electronic device to the end of the antenna coaxial cable where a positive pole region is formed by removing the outer jacket and the underneath braided mesh from a section of the antenna coaxial cable, leaving only the insulator and the core, and the braided mesh in another section of the radiation resonance region's antenna coaxial cable that does not have the outer jacket removed forms a negative pole region;

an antenna base made of a dielectric material positioned in an appropriate place on the conductor where the antenna base has a cable duct for the embedment and positioning of the antenna coaxial cable so that the positive and negative pole regions do not contact other conductive material to maintain the RF signal's stability.

2. The coaxial cable designed antenna module according to claim 1, wherein the antenna base is formed by extending from the inside of the casing of the electronic device; and the antenna base has at least a side joined to the conductor for positioning the antenna base.

3. The coaxial cable designed antenna module according to claim 2, wherein the side of the antenna base has at least a positioning pole for joining to the conductor.

4. The coaxial cable designed antenna module according to claim 2, wherein the side of the antenna base has at least a groove for joining to the conductor.

5. The coaxial cable designed antenna module according to claim 1, wherein the antenna base is an independent dielectric member inside the casing; and the antenna base has at least a side joined to the conductor for positioning the antenna base.

6. The coaxial cable designed antenna module according to claim 5, wherein the side of the antenna base has at least a positioning pole for joining to the conductor.

7. The coaxial cable designed antenna module according to claim 5, wherein the side of the antenna base has at least a groove for joining to the conductor.

8. The coaxial cable designed antenna module according to claim 1, wherein a part of or the entire cable duct has an aperture compatible with the diameter of the radiation resonance region so as to achieve tight embedment of the antenna coaxial cable.

9. The coaxial cable designed antenna module according to claim 1, wherein the negative pole region of the radiation resonance region is directly and tightly connected to the conductor of the electronic device.

10. The coaxial cable designed antenna module according to claim 1, wherein the conductor comprises a conductive material extending a resonant area of the radiation resonance region; the antenna coaxial cable is attached to the conductive material; and, to at least a portion of the outer jacket of the antenna coaxial cable corresponding to the attachment location is removed to enhance the attachment reliability.

11. The coaxial cable designed antenna module according to claim 10, wherein the core and the braided mesh at an end point of the positive pole region is connected to the conductive material of the conductor by a conduction overlapping means so as to form an equivalent capacitor and as such enhance the antenna frequency and bandwidth.

12. The coaxial cable designed antenna module according to claim 10, wherein a conductive molding is connected to the conductive material along a side of the radiation resonance region according to antenna characteristics requirement.

13. The coaxial cable designed antenna module according to claim 12, wherein the conductive molding and the conductive material are integrally formed and attached to the antenna base so as enhance the isolation from other antennas.

14. The coaxial cable designed antenna module according to claim 1, wherein a noise suppression element is configured at a specific section of the antenna coaxial cable where the outer jacket is removed and the underneath braided mesh is exposed.

15. The coaxial cable designed antenna module according to claim 1, wherein an impedance adjustment element is configured at a specific location along the antenna coaxial cable by a conduction overlapping means; and the impedance adjustment element is coated with an insulating material for enhanced mechanical strength.

16. The coaxial cable designed antenna module according to claim 1, wherein the other end of the antenna coaxial cable opposing the radiation resonance region is peeled to form a RF source; and the RF source is connected to a RF connection region of a RF transceiver by a conduction overlapping means.

* * * * *